United States Patent [19]

Reusser

[11] 4,129,971

[45] Dec. 19, 1978

[54] EDGE COVER TRIM

[75] Inventor: Hans E. Reusser, Westlake, Ohio

[73] Assignee: Republic Steel Corporation, Cleveland, Ohio

[21] Appl. No.: 792,256

[22] Filed: Apr. 29, 1977

[51] Int. Cl.[2] ..... E04B 5/00; E04B 7/00

[52] U.S. Cl. ..... 52/288; 52/718

[58] Field of Search ..... 52/287, 288, 278, 211, 52/716–718, 465, 467, 469

[56] References Cited

U.S. PATENT DOCUMENTS

| | | | |
|---|---|---|---|
| 1,772,417 | 8/1930 | Ellinwood | 52/278 X |
| 2,423,722 | 7/1947 | Nilson | 52/288 X |
| 3,500,600 | 3/1970 | Bagley | 52/211 |
| 3,525,188 | 8/1970 | Torbett | 52/288 |
| 3,568,386 | 3/1971 | Gossen | 52/288 |
| 3,717,968 | 2/1973 | Olsen et al. | 52/288 |
| 3,974,606 | 8/1976 | La Borde | 52/716 X |

*Primary Examiner*—J. Karl Bell

*Attorney, Agent, or Firm*—Watts, Hoffmann, Fisher & Heinke Co.

[57] ABSTRACT

A corner trim structure for use with formed metal sheet roofing and siding, comrising a snap-together support and resilient cover, permanently and firmly interconnected once assembled, and constructed to accommodate the ridges of roofing and siding sheets without specific contouring.

6 Claims, 2 Drawing Figures

EDGE COVER TRIM

BACKGROUND OF THE INVENTION

1. Field of the Invention

This invention relates to corner trim structure for roofing and siding.

2. Prior Art

Available corner trim for use with sheet siding or roofing for buildings is largely of one piece construction, typically with external fastening flanges, although two piece structures are shown in published art, such as U.S. Pat. Nos. 1,772,417; 1,800,609; 3,500,600; 3,667,177 and 3,875,713. Known cover trim is often recessed for sheet edge insertion, leaving gaps where valleys exist in the siding, or contour trimming is often required along an edge that abuts the siding to fit closely and follow the contour of the siding. Fasteners used with one piece constructions are exposed, and often in two-piece construction as well. See, e.g., U.S. Pat. No. 3,500,600. In snap together construction shown in published art, e.g., U.S. Pat. Nos. 1,772,417 and 3,875,713, the parts are separable after assembly. These and other shortcomings of known cover trim represent significant disadvantages that have been overcome with the present invention.

SUMMARY OF THE INVENTION

The improved corner trim structure of this invention is especially for use with formed metal sheet roofing and siding with ridges and valleys that extend parallel to the corner and that must be accommodated. The present structure overcomes shortcomings and disadvantages of known corner trim used for this purpose.

Corner trim embodying this invention is of two-piece construction that snaps together positively and permanently when assembled and installed. Both pieces are extruded of slightly flexible and resilient material, such as synthetic resin (plastic), e.g., so-called rigid vinyl. One piece serves as a support, which is fastened directly to frame structure or the like that forms a structural corner, e.g., a corner of a building. The other piece is a cover, resilient enough to snap over a retainer portion of the support. The cover conceals the support and fasteners that secure the support to the frame structure and also overlaps the edges of siding or roofing sheets at the corner of the frame structure. The preferred embodiment of the cover has two angularly-related sides of unequal width, each with an inturned edge flange so that ridges of the siding or roofing sheets that run parallel to the cover edges can be accommodated by a choice of the positioning of the cover. Resilience of the cover also allows accommodation for ridges and provides a gripping action on the support.

Gripping of the support by the cover is accomplished through retaining elements that straddle a portion of the support and space the cover outwardly from the valleys of the roofing or siding sheets, so cover surfaces extend generally parallel to the general extent of the siding, while overlying ridges of the siding. The retaining elements are constructed to cooperate with the support to permanently interconnect the cover and support and to stabilize the two in a stationary relationship. The interconnecting structure allows the cover to be snapped onto the support in a direction toward the corner apex of the building structure, along a line or plane that bisects the corner angle, so relative movement of the cover edge flanges across the siding or roofing surfaces, which movement might be obstructed by ridges of the siding or roofing, is minimized.

The edge flanges of the cover are advantageously shorter than the distance from the respective cover surface to the valleys of the roofing or siding sheets so that small ridges and lower sloped portions of higher ridges do not displace the cover surfaces from a substantially parallel relationship with the extent of the overlapped sheets.

These and other features and advantages of the invention will become more apparent from the detailed description that follows, when considered in connection with the accompanying drawing.

DETAILED DESCRIPTION

Figure 1:
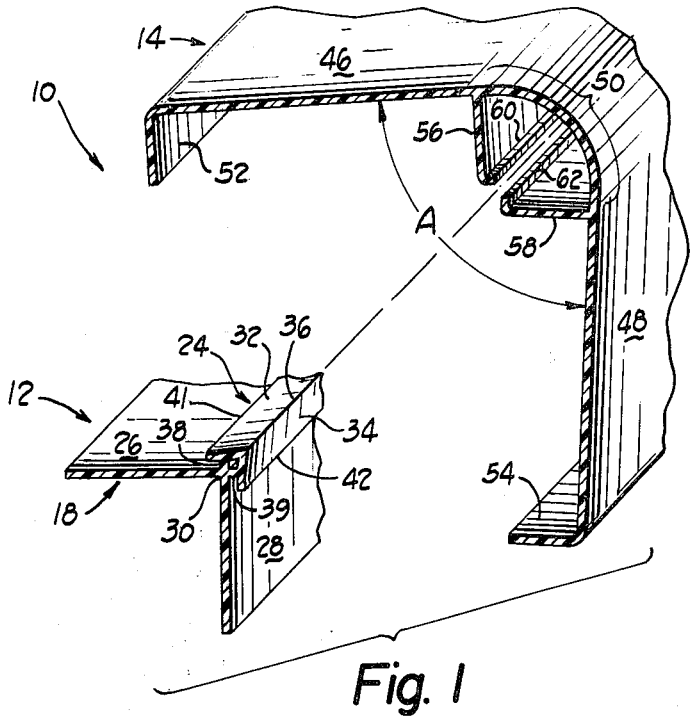
FIG. 1 is a partial perspective, unassembled, view of cover trim structure embodying the present invention.
Figure 2:
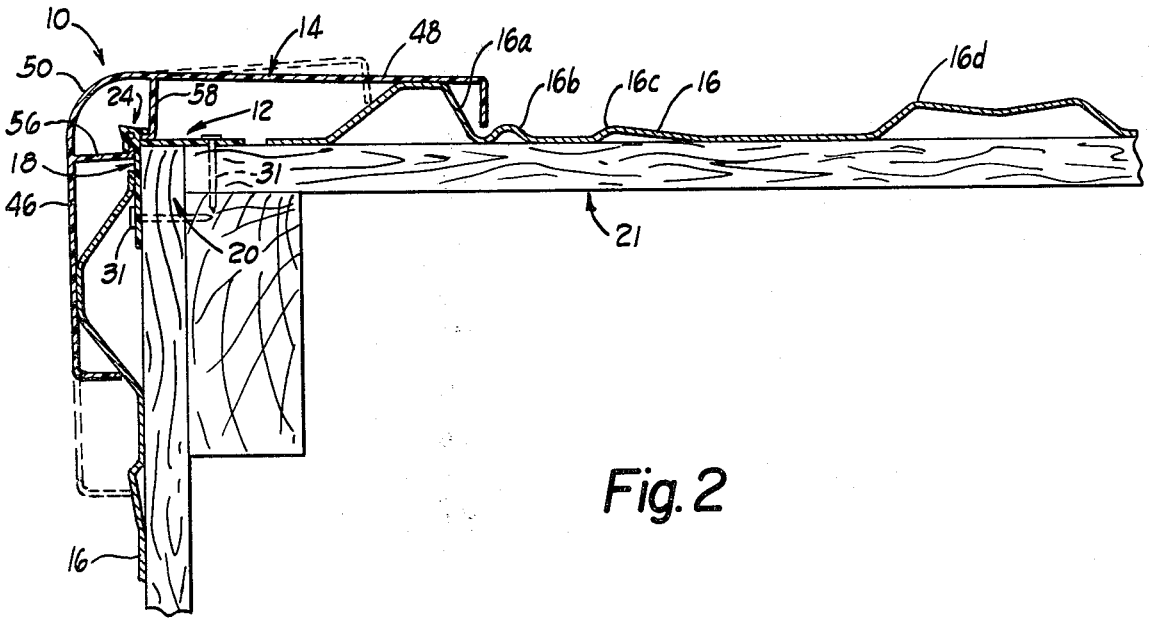
FIG. 2 is a cross sectional view of the corner trim structure shown in FIG. 1, assembled, and illustrating the manner in which it is supported on a building framework to cover the edges of formed metal sheet roofing or siding.

A preferred embodiment of corner trim structure for use with formed metal sheet roofing and siding, illustrative of the present invention, is shown in FIGS. 1 and 2 of the drawing and indicated generally by reference numeral 10. The trim structure 10 is comprised of a support 12 and a cover 14 that snap together in use. When installed as shown in FIG. 2, the cover 14 overlaps edges of metal sheets 16 used for siding, as shown, or roofing. Both the support 12 and the cover 14 are of one-piece construction, extruded, and advantageously of vinyl plastic.

The support 12 is comprised of an elongated angle portion 18 for mounting along a corner 20 of a building frame 21 (a vertical corner as shown), and a cover-retainer portion 24 to be gripped by the cover 14 for holding it to the support 12.

The angle portion 18 has a first planar part 26 and a second planar part 28 oriented at right angles to each other and meeting to form a first apex 30. When secured to the building frame 21, the angle 18 is held by fasteners, such as nails 31, driven through the planar parts 26, 28. The cover-retainer portion 24 has elongated parts 32, 34, which are generally planar and meet in a second apex 36 at the juncture of their external surfaces. In the preferred embodiment, the parts 32, 34, while generally planar, are curved slightly transversely, as shown, to better pilot snap-on portions of the cover 14 into interengaging relationship. Each part 32, 34 is supported by a longitudinal web portion 38, 39, respectively. The longitudinal web portions join the parts 32, 34 at a location approximately midway between the apex 36 and distal edges 41, 42, respectively, of the parts 32, 34. The webs 38, 39 space the cover-retainer portion (i.e., the parts 32, 34), from the angle portion 18 (i.e., from the first and second planar parts 26, 28), to allow gripping by the cover 14 beneath the cover-retainer portion. Advantageously, the webs locate the cover-retainer portion so the apex 36 and the apex 30 are in a common plane that bisects the angle between the planar parts 26, 28. To best facilitate assembly of the cover and retainer, the general convergence of the parts 32, 34 form an included angle of less than 90°, for example, 74° in the preferred embodiment.

The cover 14 is comprised of a first elongated side 46, a second elongated side 48, and an elongated curved portion 50 that integrally joins the two sides. The general extent of the sides 46, 48 forms an acute included angle A therebetween. In the preferred embodiment, the sides 46, 48 are planar. Each side 46, 48 terminates at its distal end in a flange 52, 54, respectively, that is turned inwardly of the included angle A. In a preferred embodiment, the width of the sides 46, 48, i.e., the distance from the curved portion 50 to the flanges 52, 54, is different for each side. This allows a choice of orientation of the cover 14 to best fit the contours of the siding or roofing sheets 16, which typically have ridges, such as ridges **16*a–d* in the embodiment shown. Depending upon the width of the building, different ridges may be adjacent the edge of the sheet underlying the corner trim structure. The alternative orientation of the cover 14** is shown in phantom in FIG. 2, showing that the alternative orientation in the embodiment shown is not as satisfactory with the particular siding structure and arrangement depicted.

Two retaining elements 56, 58 form a part of the cover 14. Each extends inwardly of the included angle A and along a different one of the sides 46, 48, adjacent the juncture of each side with the curved portion 50. The retaining elements 56, 58 extend in a direction perpendicularly to the respective sides 46, 48, and extend inwardly a distance from the sides greater than the width or inward extent of the flanges 52, 54. Each retaining element 56, 58 terminates at its unsupported end in an inturned flange 60, 62, respectively.

When the structure 10 is not assembled, the angle A between the sides 46, 48 is smaller than it is when the structure is assembled. By way of example, in a cover in which the angle A is intended to be 90° when the cover is assembled to the support 12, the angle A is approximately 84° prior to assembly, when the cover is in an undistorted or unstressed condition. Also, with the cover in unassembled condition, the flanges 60, 62 of the retaining elements are relatively close, closer than when the cover and retainer are assembled. In assembly, the retaining elements and sides are stressed apart, distorting the cover, with the resilience of the material tending to press the flanges of the retaining elements and the sides closer together.

The relationship of the cover 14 and retainer 12, when assembled, is shown in FIG. 2. The inturned flanges 60, 62 of the retaining elements fit between the generally planar parts 32, 34 of the cover-retainer portion and the first and second planar parts 26, 28 of the angle 18. The thickness of the inturned flanges 60, 62 is just slightly less than the distance between the angle 18 and the cover-retainer portion 24 so the flanges can be received with a clearance fit, and the width of the flanges 60, 62, is equal to the distance from the distal edges 41, 42 to the webs 38, 39. As a result of this construction, the retaining elements 56, 58 of the cover interengage with the support 12, and not only secure the cover, but also press sideways against the parts 32, 34 and webs 38, 39 to stabilize the relationship between the cover and support.

While the preferred material of the cover 14 is so-called rigid vinyl, it is inherently flexible enough and resilient enough so that the sides 46, 48 flex to the degree necessary along their length beyond the juncture with the retaining elements 56, 58 to accommodate low ridges of the siding sheets that might underlie the flanges 52, 54 without clearance even through the flanges are shorter than the retaining elements. The width of the retaining elements 56, 58 (i.e., the distance from the sides 46, 48 to the flanges 52, 54) is chosen to accommodate the highest ridge **16*a* beneath the sides 46, 48. In use, the cover is oriented to avoid interference between the side flanges 52, 54 and the highest ridges 16*a***.

The cover 14 is applied to the support 12 by forcing the flanges 60, 62 against the surfaces 32, 34 on each side of the apex 36. The resilience of the cover 14 allows the flanges 60, 62 to spread apart and slide along the surfaces 32, 34 and over the distal edges 41, 42. The flanges then snap into place between the angle 18 and the cover-retainer 24, holding the two parts permanently together in a stabilized relationship. Because each apex 30, 36 is in a common plane that bisects the angle between the planar parts 26, 28, the cover flanges 52, 54 approach the underlying siding 16 on each side of the corner with a minimum of movement in a direction along the surface of the siding. This minimizes the interference from ridges of the siding during assembly of the cover trim structure. That is, by the construction of the support 12 and cover 14, the cover is moved toward the corner in a direction that causes the flanges 52, 54 to approach the respective siding sheet at 45° angles, rather than, for example, one flange approaching at 90° and the other approaching parallel to the siding.

While a preferred embodiment of the invention has been described in detail, it will be appreciated that modifications or alterations may be made therein without departing from the spirit and scope of the invention set forth in the appended claims.

What is claimed is:

1. Corner trim structure for use with formed metal sheet roofing and siding, comprising a snap together support and resilient cover; said support comprising an elongated angle member formed of first and second planar parts meeting at a first apex, and an integral cover-retainer portion along the apex externally of the angle member, said cover-retainer portion comprising an elongated member with a second apex and diverging surfaces that terminate in flange-like marginal portions that define side edges extending longitudinally of the angle member, the second apex, marginal portions and side edges being spaced from the planar parts of the angle member; and said cover comprising first and second elongated sides, the general extents of which form an acute included angle therebetween, a portion along the distal edge of each side extending inwardly of the included angle, and first and second retaining elements extending inwardly of the included angle from the first and second sides, respectively, of the cover, each retaining element terminating along its distal edge in a portion that fits between one of the planar parts of the angle member and the overlying flange-like marginal portion of the cover-retainer portion of the support, when the cover and support are assembled.

2. Corner trim structure for use with formed metal sheet roofing and siding, comprising a snap together support and resilient cover; said support comprising an elongated angle member formed of first and second planar parts meeting at a first apex, and an integral cover-retainer portion along the apex externally of the angle member, said cover-retainer portion comprising an elongated member with a second apex and diverging surfaces that terminate in flange-like marginal portions that define side edges extending longitudinally of the angle member, the second apex, marginal portions and side edges being spaced from the planar parts of the angle member; and said cover comprising first and second elongated sides, the general extents of which form an acute included angle therebetween, a flange at the distal edge of each side extending inwardly of the included angle, and first and second retaining elements extending inwardly of the included angle from the first and second sides, respectively, of the cover, each retaining element terminating along its distal edge in a portion that fits between one of the planar parts of the angle member and the overlying flange-like marginal portion of the cover-retainer portion of the support, portions of the retaining elements that contact the cover-retainer portion being spaced apart a distance less than the distance between the contacted portions of the cover-retainer portion when the cover is undistorted and being biased toward each other against the contacted portions when the cover and support are assembled.

3. Corner trim structure for use with formed metal sheet roofing and siding, comprising a snap together support and resilient cover; said support comprising an elongated angle member formed of first and second planar parts meeting at a first apex, and an integral cover-retainer portion along the apex externally of the angle member, said cover-retainer portion comprising an elongated member with a second apex and diverging surfaces that terminate in flange-like marginal portions that define side edges extending longitudinally of the angle member, the second apex, marginal portions and side edges being spaced from the planar parts of the angle member and the marginal portions defining cover-retaining surfaces substantially parallel to the first and second planar parts; and said cover comprising first and second elongated sides, the general extents of which form an acute included angle therebetween, an elongated curved portion joining the sides, a flange at the distal edge of each side extending inwardly of the included angle, and first and second retaining elements extending inwardly of the included angle from the first and second sides, respectively, of the cover and perpendicular to the general extent of the respective side, each retaining element terminating along its distal edge in an inturned flange that fits between one of the planar parts of the angle member and the overlying flange-like marginal portion of the cover-retainer portion of the support, portions of the retaining elements that contact the cover-retainer portion being spaced apart a distance less than the distance between the contacted portion of the cover-retainer portion when the cover is undistorted.

4. Corner trim structure for use with formed metal sheet roofing and siding, comprising a snap together support and resilient cover; said support comprising an elongated first angle member formed of first and second planar parts meeting at a first apex, and an integral cover-retainer along the apex externally of the angle member, said cover-retainer comprising a second elongated angle member formed of third and fourth generally planar parts meeting at a second apex and supported on the first angle member with the third and fourth planar parts spaced from and generally parallel to the first and second planar parts and having distal marginal portions extending beyond the support with the first angle member; and said cover comprising first and second angularly related, elongated, sides the general extents of which form an acute included angle, a flange at the distal edge of each side extending inwardly of the included angle, and first and second retaining elements extending inwardly of the included angle from the first and second sides, respectively, of the cover and perpendicular to the general extent of the respective side, each retaining element terminating along its distal edge in an inturned flange with flat surfaces that fits between one of the planar parts of the angle member and the marginal portion of the cover-retainer of the support, portions of the retaining elements that contact the second angle member being spaced apart a distance less than the distance between the contacted portion of the second angle member when the cover is undistorted.

5. Corner trim structure for use with formed metal sheet roofing and siding, comprising a snap together support and resilient cover; said support comprising an elongated first angle member formed of first and second planar parts meeting at a first apex, and an integral cover-retainer along the apex externally of the angle member, said cover-retainer comprising a second elongated angle member formed of third and fourth generally planar parts meeting at a second apex and supported on the first angle member intermediate the second apex and distal edges of the third and fourth planar parts, with the third and fourth planar parts spaced from and generally parallel to the first and second planar parts; and said cover comprising first and second angularly related, elongated, sides the general extents of which form an acute included angle, an elongated curved portion joining the sides, a flange at the distal edge of each side extending inwardly of the included angle and generally perpendicular to the general extent of the respective side, and first and second retaining elements extending inwardly of the included angle from the first and second sides, respectively, of the cover and perpendicular to the general extent of the respective side, each retaining element terminating along its distal edge in an inturned flange that fits and fills the distance between the planar parts of the angle member and cover-retainer of the support, portions of the retaining elements that contact the second angle member being spaced apart a distance less than the distance between the contacted portion of the second angle member when the cover is undistorted.

6. Corner trim structure for use with formed metal sheet roofing and siding, comprising a snap together support and resilient cover; said support comprising an elongated first angle member formed of first and second planar parts meeting at a first apex, and an integral cover-retainer along the apex externally of the angle member, said cover-retainer comprising a second elongated angle member formed of third and fourth generally planar parts meeting at a second apex and supported on the first angle member intermediate the second apex and distal edges of the third and fourth planar parts, with the third and fourth planar parts spaced from and generally parallel to the first and second planar parts and with the first and second apices in a common plane that bisects the angle included between the first and second planar parts; and said cover comprising first and second angularly related, elongated, sides, one of which is wider than the other and the general extents of which form an acute included angle, an elongated curved portion joining the sides, a flange at the distal edge of each side extending inwardly of the included angle and generally perpendicular to the general extent of the respective side, and first and second retaining elements extending inwardly of the included angle from the first and second sides, respectively, of the cover and perpendicular to the general extent of the respective side, each retaining element terminating along its distal edge in an inturned flange that fits and fills the distance between the planar parts of the angle member and cover-retainer of the support, portions of the retaining elements that contact the second angle member being spaced apart a distance less than the distance between the contacted portion of the second angle member when the cover is undistorted and being biased toward each other against the contacted portions when the cover and support are assembled.

* * * * *